United States Patent [19]

Pask et al.

[11] Patent Number: 4,492,521

[45] Date of Patent: Jan. 8, 1985

[54] SEALED AEROFOIL BLADE/DISC ASSEMBLY FOR A ROTOR

[75] Inventors: George Pask; Clive E. Brett, both of Derby, England

[73] Assignee: Rolls-Royce Limited, London, England

[21] Appl. No.: 493,268

[22] Filed: May 10, 1983

[30] Foreign Application Priority Data

Jun. 17, 1982 [GB] United Kingdom ..... 8217518

[51] Int. Cl.[3] ..... F01D 5/30

[52] U.S. Cl. ..... 416/193 A; 416/215

[58] Field of Search ..... 416/193 A, 193 R, 215, 416/218, 217

[56] References Cited

U.S. PATENT DOCUMENTS

| | | | |
|---|---|---|---|
| 1,891,948 | 12/1932 | Rice | 416/217 |
| 2,414,278 | 1/1947 | Soderberg | 416/217 |
| 2,683,018 | 7/1954 | Schörner | 416/218 X |
| 2,936,155 | 5/1960 | Howell et al. | 416/193 A X |
| 3,053,504 | 9/1962 | Shelley | 416/215 |
| 3,073,569 | 1/1963 | Wagner | 416/193 A X |
| 3,584,971 | 6/1971 | Ortolano | 416/218 |
| 3,610,772 | 10/1971 | Wagle | 416/218 X |
| 3,881,844 | 5/1975 | Hennessey et al. | 416/218 X |
| 4,415,310 | 11/1983 | Bouiller et al. | 416/95 |

FOREIGN PATENT DOCUMENTS

| | | | |
|---|---|---|---|
| 564048 | 9/1958 | Canada | 416/215 |
| 818276 | 10/1951 | Fed. Rep. of Germany | 416/215 |

*Primary Examiner*—Everette A. Powell, Jr.

*Attorney, Agent, or Firm*—Cushman, Darby & Cushman

[57] ABSTRACT

An aerofoil blade/disc assembly suitable for the compressor or turbine of a gas turbine engine comprising a rotor disc which has a circumferential, part-circular cross-section channel provided in its periphery for the reception of the correspondingly part-circular cross-section roots of an annular array of aerofoil blades. The arrangement is such that upon disc rotation, the aerofoil blades pivot with respect thereto until their platforms sealingly engage a circumferential radially extending flange provided on the disc periphery. A seal is provided between the aerofoil blades and the disc which reduces the leakage of gases between the aerofoil blade roots and their retaining channel.

4 Claims, 2 Drawing Figures

SEALED AEROFOIL BLADE/DISC ASSEMBLY FOR A ROTOR

This invention relates to the mounting of aerofoil blades on a rotary disc and in particular to the mounting of aerofoil blades in a circumferential aerofoil blade root retaining channel provided in the disc periphery.

It is well known to provide a disc for an axial flow compressor or turbine with a circumferential channel in its periphery which is adapted to receive and retain the roots of a plurality of aerofoil blades. Whilst such an arrangement is effective in providing acceptable aerofoil blade support, it does present problems in achieving a satisfactory level of sealing against gas leakage across the region of interconnection between the aerofoil blades and the disc. Gas leakage of this sort is undesirable in view of the detrimental effect which it has on the efficiency of the compressor or turbine concerned.

It is an object of the present invention to provide an aerofoil blade/disc assembly suitable for the compressor or turbine of a gas turbine engine in which the aerofoil blades are mounted in a circumferentially extending channel in the periphery of the disc and which has an improved degree of sealing against gas leakage across the region of interconnection between the aerofoil blades and the disc.

According to the present invention, an aerofoil blade/disc assembly suitable for the compressor or turbine of a gas turbine engine comprises a rotor disc having an annular array of aerofoil blades mounted around its periphery, each of said blades having an aerofoil cross-section portion and a root portion for the attachment of said blade to said disc, each of said root portions being of part-circular cross-section shape and received and retained within a circumferential channel of corresponding part-circular cross-section shape provided in the periphery of said disc, the arrangement being such that a limited degree of pivotal movement of each of said aerofoil blades relative to the disc is permitted, each of said aerofoil blades being so configured that its centre of gravity is so positioned that upon rotation of said disc, each of said aerofoil blades pivots with respect to said disc until a portion thereof sealingly engages a circumferential radially extending feature provided on said disc so that a seal is defined between said aerofoil blades and said disc.

Each of said aerofoil blades is preferably provided with a platform portion which is interposed between said aerofoil cross-section and root portions.

Said platform portion of each aerofoil blade is preferably the portion of each of said aerofoil blades which sealingly engages said circumferential radially extending feature provided on said disc.

Said circumferential radially extending feature provided on said disc is preferably constituted by a flange.

Figure 1:
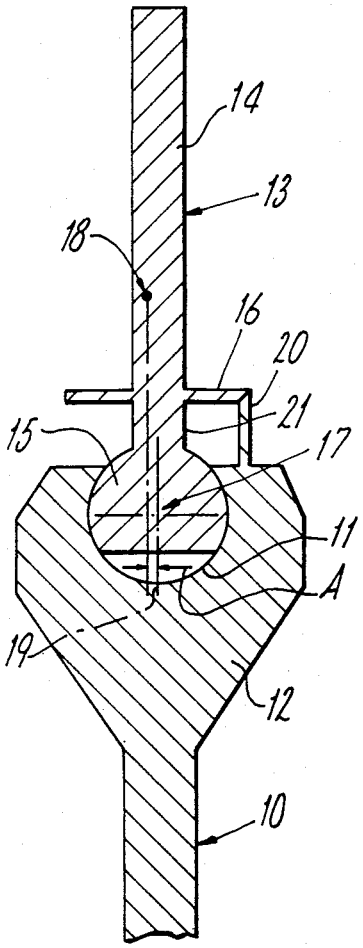
Figure 2:
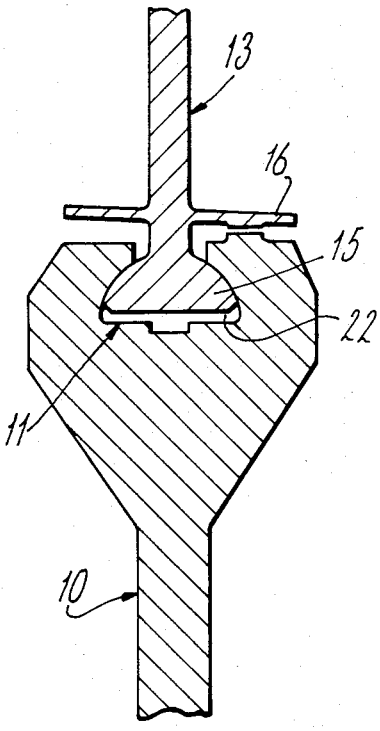

The invention will now be described, by way of example, with reference to the accompanying drawings in which FIG. 1 is a sectional side view of a part of an aerofoil blade/disc assembly in accordance with an embodiment of the present invention, and FIG. 2 is a similar view of a further embodiment of the invention.

With reference to the drawings, a gas turbine engine rotor disc 10, a portion of the peripheral region of which can be seen, is provided with a circumferential channel 11 in its periphery 12. The circumferential channel 11 is of part-circular cross-section to receive and retain the correspondingly shaped cross-section root portions 15 of an annular array of aerofoil blades 13, one of which can be seen in the drawing. Each aerofoil blade 13 has, in addition to a root portion 15, an aerofoil cross-section portion 14 and a platform portion 16, the platform portion 16 being interposed between the root and aerofoil cross-section portions 14 and 15. The root portions 15 and the circumferential channel 11 are so configured that a limited degree of pivotal movement of each of the aerofoil blades 13 about their axes 17 relative to the disc 10 is permitted.

Each aerofoil blade 13 is so configured that its centre of gravity 18 is axially displaced by a distance A from a radial line 19 passing through the pivotal axis 17. This ensures that upon rotation of the disc 10 each of the aerofoil blades 13 pivots about its pivotal axis 17. The centres of gravity of the aerofoil blades 13 are so positioned that upon rotation of the disc 10, all of the blades 13 pivot towards a circumferential radially extending flange 20 provided on the disc periphery 12 adjacent the aerofoil blades 13. The platform portions 16 of the aerofoil blades 13 are so positioned that they sealingly engage the flange 20, thereby defining a seal between the aerofoil blades 13 and the disc 10. This minimises the leakage between the root portion 15 and the channel 11 of some of the gases which pass in operation over the aerofoil cross-section portion 14 of the aerofoil blade 13.

It will be appreciated that although the present invention has been described with reference to an aerofoil blade/disc assembly in which the blade platform portions 16 engage the flange 20, the flange 20 could be so arranged as to sealingly engage other portions of the aerofoil blades 13, such as the shank portion 21 between the platform portion 16 and the root portion 15. In such cases, the flange 20 would have to be appropriately configured so as to ensure an effective seal.

It will also be appreciated that the present invention is applicable to an aerofoil blade/disc assembly for either the compressor or turbine of a gas turbine engine.

In the embodiment shown in FIG. 2, the circumferential channel 11 is reduced in depth, compared with the corresponding channel in FIG. 1. The root portion 15 of blade 13 is also reduced, so that a clearance 22 is provided to enable limited pivoting of the blade 13 to take place. The magnitude of pivotal movement is controlled by the eventual engagement of the blade platform 16 and a circumferential abutment 24 on the rim of disc 10.

We claim:

1. An aerofoil blade/disc assembly for a rotor of a compressor or turbine of a gas turbine engine comprising:

a rotor disc having an axis of rotation, said rotor disc including a circumferential channel opening to a periphery of the same, said circumferential channel having a part circular cross-sectional shape on at least a radially inwardly facing surface of the same;

an annular array of rotor blades mounted on said rotor disc, each blade of said array of rotor blades including an aerofoil cross-section portion and a root portion, said root portion having a part circular cross-sectional shape complimentary to and engaging said part circular cross-sectional shape of said circumferential channel to provide a limited degree of pivotal movement of said blade to said disc about a pivot axis, each said blade having a center of gravity offset relative to a radial plane perpendicular to said axis of rotation of said disc and extending through said pivot axis so that said blade pivots with respect to said disc upon rotation of said disc;

and means operative when said rotor disc is rotating to define a seal between said annular array of rotor blades and said rotor disc, said means including a circumferential radially extending feature provided on the periphery of said disc and a seal portion on each of said blades, said seal portion on each of said blades sealingly engaging with said feature when said disc is rotating and said blades have pivoted.

2. An aerofoil blade/disc assembly for a rotor as claimed in claim 1 wherein each of said aerofoil blades is provided with a platform portion which is interposed between said aerofoil cross-section portion and said root portion.

3. An aerofoil blade/disc assembly for a rotor as claimed in claim 2 wherein said platform portion of each aerofoil blade is said seal portion which sealingly engages said circumferential radially extending feature provided in said disc.

4. An aerofoil blade/disc assembly for a rotor as claimed in claim 3 wherein said circumferential radially extending feature provided on said disc is constituted by a flange which is engaged by said platform portion of each of said blades when said blades are pivoted by rotation of said disc.

* * * * *